US010875739B2

(12) United States Patent
Hall et al.

(10) Patent No.: US 10,875,739 B2
(45) Date of Patent: Dec. 29, 2020

(54) DETACHABLE LINE GUIDE

(71) Applicant: Hall Labs, LLC, Provo, UT (US)

(72) Inventors: David R. Hall, Provo, UT (US); Jerome Miles, Spanish Fork, UT (US); Daniel Madsen, Vineyard, UT (US)

(73) Assignee: Hall Labs LLC, Provo, UT (US)

( * ) Notice: Subject to any disclaimer, the term of this patent is extended or adjusted under 35 U.S.C. 154(b) by 137 days.

(21) Appl. No.: 16/034,337

(22) Filed: Jul. 12, 2018

(65) Prior Publication Data

US 2020/0017330 A1 Jan. 16, 2020

(51) Int. Cl.
*B65H 57/26* (2006.01)
*B65H 75/44* (2006.01)

(52) U.S. Cl.
CPC ..... *B65H 57/26* (2013.01); *B65H 75/4407* (2013.01); *B65H 75/4486* (2013.01)

(58) Field of Classification Search
CPC . B65H 57/26; B65H 75/4407; B65H 75/4486
See application file for complete search history.

(56) References Cited

U.S. PATENT DOCUMENTS 4,513,772 A * 4/1985 Fisher ..... B65H 75/4407 137/355.22
4,616,791 A * 10/1986 Harvey ..... A01G 25/095 242/390.1
4,655,399 A * 4/1987 Harvey ..... A01G 25/095 137/355.21
8,336,800 B1 * 12/2012 Lopez ..... B65H 75/4407 242/390.8
2007/0119997 A1 * 5/2007 Boon ..... B65H 75/425 242/159
2010/0294872 A1 * 11/2010 Wang ..... B65H 75/4486 242/390.8
2012/0227815 A1 * 9/2012 Zink ..... B65H 75/38 137/1
2012/0255380 A1 * 10/2012 Wu ..... B65H 75/483 74/89.37
2018/0118505 A1 * 5/2018 Prince ..... B65H 75/30
2018/0155150 A1 * 6/2018 Belani ..... B64F 3/00
2019/0161201 A1 * 5/2019 Espinosa-Sanchez ..... B65H 75/4478

* cited by examiner

*Primary Examiner* — Sang K Kim

(57) ABSTRACT

A detachable line guide is disclosed. A screw with a helical groove between threads is provided. A guide is positioned a fixed distance perpendicular to the screw and can travel laterally freely. A follower mount is detachably affixed to the guide. The follower mount has a follower that is biased into the groove. Rotation of the screw causes the follower to track the groove and move the follower mount laterally. The guide is configured for a line to pass therethrough. When the line exerts a lateral force above a predetermined threshold against the guide, the guide and the follower mount detach.

10 Claims, 3 Drawing Sheets

200

DETACHABLE LINE GUIDE

TECHNICAL FIELD

The invention described herein relates generally to spooling.

BACKGROUND

Line guides, capable of keeping a line on track when winding or unwinding the line require the ability to handle forces in multiple directions. In many instances, the human hand is used to guide lines due to the expense and complexity of a line guide as well as due to the human capacity to handle changes in force and direction quickly. When using mechanical devices, such as a line guide for a winch pulling a load via a line, the line guide may experience forces in lateral directions. For example, a winch mounted facing one direction may be pulling on an object to the side of the face of the winch. The force may be partially compensated for by a fairlead, but when the forces become too high laterally, the line guide can be broken.

SUMMARY

In a first aspect, the disclosure provides a screw with a helical groove between threads. A guide is positioned a fixed distance perpendicular to the screw and can travel laterally freely. A follower mount is detachably affixed to the guide. The follower mount has a follower that is biased into the groove. Rotation of the screw causes the follower to track the groove and move the follower mount laterally. The guide is configured for a line to pass therethrough. When the line exerts a lateral force above a predetermined threshold against the guide, the guide and the follower mount detach.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
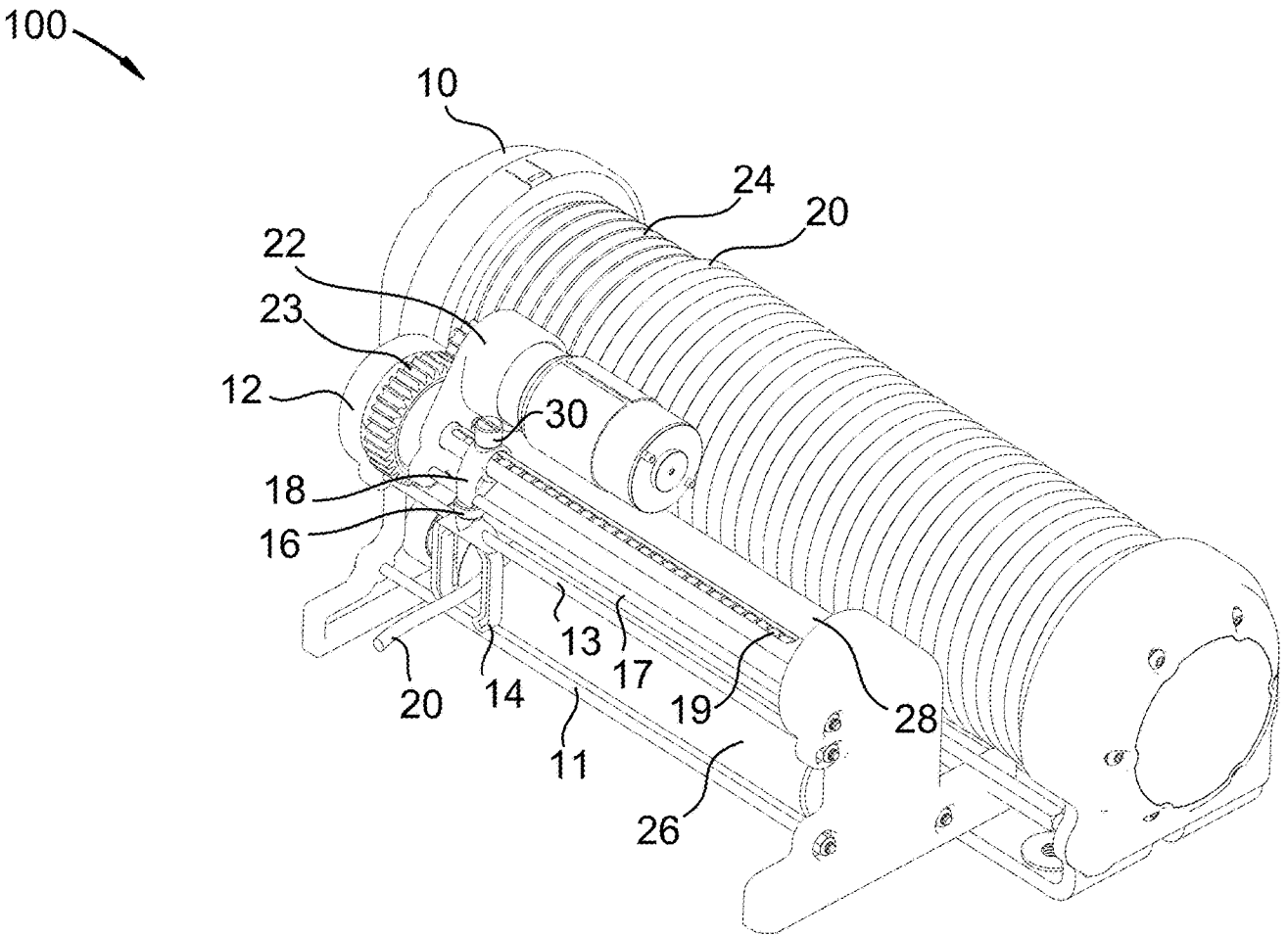
FIG. 1 is a front-right top isometric view of a winch with a line guide assembly.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "spooling device" is meant to refer to a device that winds such as a spooler, winch, winder, and coilers.

As used herein, "line" is meant to refer to cable, wire, line, cord, twine, strand, or rope.

Line guides, capable of keeping a line on track when winding or unwinding the line, require the ability to handle forces in multiple directions. In many instances, the human hand is used to guide lines due to the human capacity to handle changes in force and direction quickly. When using mechanical devices, such as a line guide for a winch pulling a load via a line, the line guide may experience forces in lateral directions that are not compensated for by a fairlead, which can break the line guide. A line guide that can be used both with and without lateral loads is disclosed herein. In a preferred embodiment, the line guide is mounted to a screw by a follower mount. The screw is preferably a bidirectional helical screw, but any screw can be utilized. The follower mount has a follower that tracks the screw as the screw rotates, moving the line guide laterally. The line guide is mounted on a rod or other guide that allows the line guide to move laterally at a fixed distance from the screw. A line passes through the guide. When the line exerts a lateral force against the guide above a sheer strength, the guide and the follower mount detach. The follower mount continues to move with the screw while the guide moves laterally with the line. The follower mount can then be moved laterally to remount the guide.

Figure 2:
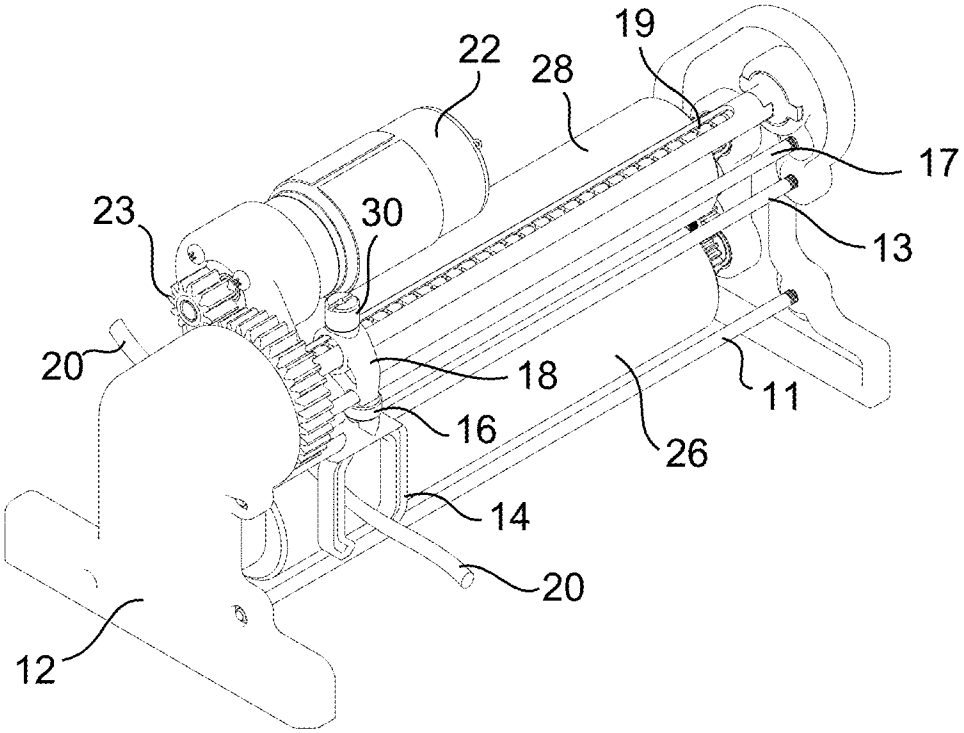
FIG. 2 is a front-left top isometric view of the line guide assembly of FIG. 1.
Figure 3:
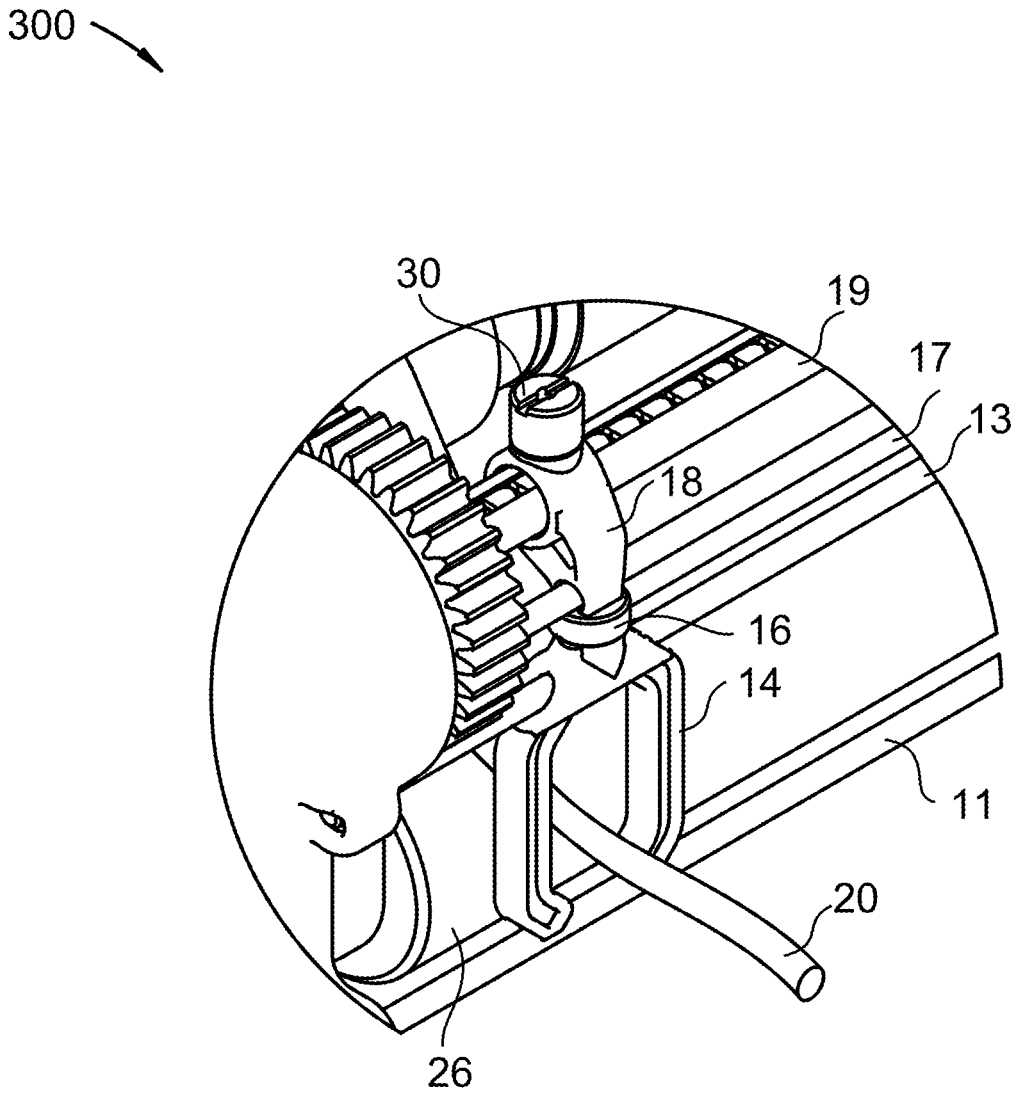
FIG. 3 is a front-left top isometric close-up view of the line guide of FIG. 2.

FIG. 1 is a front-right top isometric view 100 of a winch with a line guide assembly that may be used with the devices disclosed herein. FIG. 2 is a front-left top isometric view 200 of the line guide assembly of FIG. 1. FIG. 3 is a front-left top isometric close-up view 300 of the line guide of FIG. 2. A winch 10 has a spool 24, an internal motor (not shown), and a line guide assembly 12. The line guide assembly 12 consists of a top roller 28, a bottom roller 26, a line guide 14, a follower mount 18 with a magnet 16, a motor 22 with gears 23, a line guide bottom rod 11, a line guide top rod 13, a follower mount rod 17, and a screw 19. In this embodiment, the screw 19 is a bidirectional screw with two counter-rotating helical grooves. In other embodiments, the screw has a single direction. The motor 22 rotates the gears 23 which move rotate the screw 19 and the rollers 26 and 28. The follower mount 18 has a follower 30 that fits into the grooves of the screw 19. The screw 19 is rotated which causes the follower 30 to track the groove, which moves the follower mount 18 laterally along rod 17.

A line 20 is spooled around the spool 24, passed between the rollers 26 and 28, and passed through the line guide 14. As the winch 10 rotates the spool 24 to wind or unwind the line 20, screw 19 rotates to move the guide 14 along the rods 11 and 13, putting the line 20 in alignment with the location on the spool 24 where the line 20 is winding or unwinding. When the line pulls against a side of the guide 14 the line exerts a lateral force on the line guide 14. When the lateral force is above a predetermined threshold the guide 14 and the follower mount 18 detach. In a preferred embodiment, the follower mount 18 attaches to the line guide 14 by the magnet 16. The magnet 16 may be a permanent magnet, an electromagnet, or an electropermanent magnet. In the embodiment where the magnet 16 is a permanent magnet, the force of the line 20 pulling laterally causes the permanent magnet to be sheered from the guide 14. Below the predetermined threshold, the line 20 pulling laterally does not overcome the magnetic force holding the line guide 14 to the follower mount 18. As the force reaches or exceeds the predetermined threshold, the magnetic force can no longer keep the line guide 14 and the follower mount 18 together. The line guide 14 and the follower mount 18 slide apart.

In the embodiment where the magnet 16 is an electromagnet, the force of the line 20 pulling laterally is detected by one or more sensors and the electric power to the magnet 16 is stopped, resulting in the line guide 14 and the follower mount 18 no longer having any force holding them together, such that the lateral force drags the line guide 14 away from the follower mount 18. For reattachment, the electric power is restored and the follower mount 18 is moved laterally to the line guide 14, which then reattach. For example, the sensors could be strain gages, including mechanical, optical, acoustical, pneumatic, or electrical type gauges.

In the embodiment where the magnet 16 is an electropermanent magnet, the force of the line 20 pulling laterally is detected by one or more sensors and electric power is provided momentarily to switch the magnet 16 off, resulting in the line guide 14 and the follower mount 18 no longer having any force holding them together, such that the lateral force drags the line guide 14 away from the follower mount. For reattachment, electric power is again provided momentarily to switch the magnet 16 back on and the follower mount 18 is moved laterally to the line guide 14, which then reattach. For example, the sensors could be strain gages, including mechanical, optical, acoustical, pneumatic, or electrical type gauges.

In some embodiments, one or more sensors may be used that detect a spooling location of the line on the spooling device and compare it to a guide location of the line in the guide. In one embodiment, when the one or more sensors determine that the spooling location and the guide location are misaligned, the screw rotates faster or slower than the spooling device until the spooling location and the guide location are aligned. In another embodiment, when the one or more sensors determine that the spooling location and the guide location are misaligned, the spooling device stops rotating while the screw rotates, moving the following device until the spooling location and the guide location are aligned. The location sensors could include potentiometers, optical, magnetic, magnetorestrictive, capacitive, inductive, and ultrasonic. The sensors could be attached to the line guide or the follower mount.

The guide has a lateral force that results in breaking. For example, a guide on a commercially available 12,000 lb rated winch breaks above about 100 lbs of lateral force. In other embodiments, breakage testing of each type of guide will have to be conducted to determine breakage forces.

In all embodiments, the predetermined threshold is below the lateral force at which the guide breaks. Selection of how far below depends upon the purpose of the guide. In some embodiments, the guide is used as an addition to the existing fairlead. In such cases, the predetermined threshold is preferably as close to the force at which the guide breaks as possible without actually breaking. In some embodiments, this would be no more than 80% of the force at which the guide breaks. In a more preferred embodiment, this would be no more than 90% of the force at which the guide breaks. In a most preferred embodiment, this would be no more than 95% of the force at which the guide breaks.

In other embodiments, the purpose of the line guide is not to be load bearing and so the predetermined threshold would be lower. In some embodiments, this would be no more than 50% of the force at which the line guide breaks. In a more preferred embodiment, this would be no more than 30% of the force at which the line guide breaks. In a most preferred embodiment, this would be no more than 10% of the force at which the guide breaks.

In some embodiments, the screw is made of steel or stainless steel, is heat treated, or is surface hardened. In the commercially available 12,000 lb rated winch, the screw can have a diameter of between 6 mm and 12 mm with a pitch of 6 mm. In other embodiments, the pitch and motor gearing would require modification to the keep the coils of line next to each other. Incorrect pitch and gearing leads to spooling that either bunches up or has gaps. Selection of these parameters is well within the abilities of a person of normal skill in the art.

In some embodiments, the follower is made of steel, aluminum, or a plastic. The metal chosen should be dissimilar to the metal of the screw. Preferably, the follower and the screw are coated with a protective coating such as titanium nitride, titanium carbo-nitride, titanium aluminum nitride, aluminum titanium nitride, chrome nitride, zirconium nitride, chrome, or a combination thereof.

In some embodiments, the guide and follower mount are made of plastic or aluminum.

In some embodiments, a first optical sensor may be used that detects when the follower mount is affixed to the guide. In some embodiments, the screw stops rotating when the first optical sensor does not detect the mount is affixed to the guide. In some embodiments, a second optical sensor detects the location of the guide and a third optical sensor detects the location of the follower mount. The screw rotates to move the follower mount towards the guide when the first optical sensor does not detect the follower mount is affixed to the guide.

In other embodiments, the motor for the spooling device also drives the screw. The spooling device may be a winch, a windlass, or a spooler. Preferably, the spooling device is a winch.

In some embodiments, the line being spooled may consist of a cable, wire, line, cord, twine, strand, or rope. Preferably, the line is a cable made of braided metal wire.

In some embodiments, the guide may be attached to a pipe or tube and may be used to direct fluid flow. The fluids directed may be supercritical fluids, cryogenic fluids, molten glasses, or a combination thereof.

In some embodiments, the apparatus may be used in a 3D printer, additive manufacturing device, or rapid prototyping machine. The line in these embodiments is a tube through which chemicals are passed. The line guide moves the tube laterally, orienting the tube to discharge the chemicals to the appropriate location for printing, manufacturing, or prototyping, respectively.

The invention has been described with reference to various specific and preferred embodiments and techniques. Nevertheless, it is understood that many variations and modifications may be made while remaining within the spirit and scope of the invention.

What is claimed is:

1. An apparatus comprising:

a screw comprising a helical groove;

a guide positioned at a fixed distance perpendicular to the screw, wherein the guide can travel laterally;

a follower mount detachably affixed to the guide and comprising a follower, wherein the follower fits into the helical groove, and wherein rotation of the screw causes the follower to track the groove and move the follower mount laterally; and wherein the guide is configured for a line to pass therethrough, wherein when the line exerts a lateral force above a predetermined threshold against the guide, wherein the guide and the follower mount detach from each other.

2. The apparatus of claim 1, wherein the guide is attached to a rod at a fixed distance from the screw, wherein the guide can move laterally freely along the rod.

3. The apparatus of claim 1, wherein the line comprises a braided-metal cable.

4. The apparatus of claim 3, wherein the follower mount is detachably affixed to the guide by a magnet.

5. The apparatus of claim 1, wherein the screw is rotated by a first motor and a spooling device is rotated by a second motor.

6. The apparatus of claim 5, wherein the spooling device comprises a winch, a windlass, or a spooler.

7. The apparatus of claim 1, wherein the screw and a spooling device are rotated by a motor.

8. The apparatus of claim 1, wherein the screw comprises two counter-rotating helical grooves so as to be self-reversing.

9. The apparatus of claim 1, wherein the screw comprises a coating selected from the group consisting of titanium nitride, titanium carbo-nitride, titanium aluminum nitride, aluminum titanium nitride, chrome nitride, zirconium nitride, chrome, and combinations thereof.

10. The apparatus of claim 1, wherein the follower comprises a coating selected from the group consisting of titanium nitride, titanium carbo-nitride, titanium aluminum nitride, aluminum titanium nitride, chrome nitride, zirconium nitride, chrome, and combinations thereof.

* * * * *